United States Patent [19]

Yagyu et al.

[11] Patent Number: 4,534,268

[45] Date of Patent: Aug. 13, 1985

[54] HYDRAULIC FLUID CIRCUIT OF HYDRAULIC SHOVEL

[75] Inventors: Takashi Yagyu, Ibaraki; Takeshi Yamaguchi, Tsuchiura; Sotaro Tanaka; Yasuo Sakaki, both of Ibaraki, all of Japan

[73] Assignee: Hitachi Construction Machinery Co., Ltd., Tokyo, Japan

[21] Appl. No.: 396,878

[22] Filed: Jul. 9, 1982

[30] Foreign Application Priority Data

Jul. 10, 1981 [JP] Japan ..... 56-101830[U]

[51] Int. Cl.[3] ..... F15B 11/16

[52] U.S. Cl. ..... 91/6; 91/523; 91/529; 91/461; 91/530

[58] Field of Search ..... 91/6, 527, 531, 530, 91/536, 510, 523, 529, 528, 461, 304; 60/480

[56] References Cited

U.S. PATENT DOCUMENTS

| | | | |
|---|---|---|---|
| 3,800,669 | 4/1974 | Distler | 91/530 |
| 4,073,141 | 2/1978 | Lohbauer | 91/510 |
| 4,142,445 | 3/1979 | Lohbauer | 91/6 |
| 4,207,740 | 6/1980 | Ripa | 91/530 |
| 4,367,624 | 1/1983 | Ogata et al. | 91/6 |

FOREIGN PATENT DOCUMENTS

| | | | |
|---|---|---|---|
| 1380371 | 1/1975 | United Kingdom | 91/530 |

*Primary Examiner*—Robert E. Garrett
*Assistant Examiner*—Richard S. Meyer
*Attorney, Agent, or Firm*—Antonelli, Terry & Wands

[57] ABSTRACT

A hydraulic fluid circuit of a hydraulic shovel including a first directional control valve group connected to a first hydraulic pump and including a first directional control valve and a second directional control valve respectively connected to a first hydraulic cylinder and a second hydraulic cylinder. A second directional control valve group, connected to a second hydraulic pump, includes a third directional control valve having a first working port connected to one cylinder chamber of the first hydraulic cylinder and a second working port connected to one cylinder chamber of the second hydraulic cylinder. A switching device in the hydraulic fluid circuit is operative, when the first directional control valve is in a first position to switch the third directional control valve to a first position for supplying hydraulic fluid from the second hydraulic pump to the first hydraulic cylinder through the first working port, and also operative, when the second directional control valve is in a second position, to switch the third directional control valve to a second position for supplying hydraulic fluid from the second hydraulic pump to the second hydraulic cylinder through the second working port.

3 Claims, 3 Drawing Figures

HYDRAULIC FLUID CIRCUIT OF HYDRAULIC SHOVEL

BACKGROUND OF THE INVENTION

This invention relates to a hydraulic fluid circuit of a hydraulic shovel.

As shown in FIG. 1, a prior art loading shovel includes a lower travel member 1, a swing 2, a boom 3, an arm 4, a bucket 5, a hydraulic boom cylinder 6, a hydraulic arm cylinder 7, and a hydraulic bucket cylinder 8, for driving the front loading portion including the boom 3, arm 4, and bucket 5.

As shown in FIG. 2, a prior art hydraulic fluid circuit for the loading shovel includes hydraulic pumps 9, 10 and directional control valve groups generally designated by the reference numerals 11, 12 respectively connected to the hydraulic pumps 9, 10. The directional control valve groups 11, 12 are of the four valve type of the same construction, with one valve group 11 comprising a boom control valve 13, a left travel control valve 35, an arm control valve 15, and a swing control valve 36, and the other group 12 comprising a boom control valve 14, a right travel control valve 37, a bucket control valve 16 and a reserve control valve 38.

The hydraulic circuit further includes a pilot pump, a relief valve 18, a control pilot valve 19 for the boom control valves 13, 14 a control pilot valve 20 for the arm control valve 15, and a control pilot valve 21 for the bucket control valve 16. Left and right travel control valves 35, 37, forming a control circuit, are connected to the hydraulic fluid circuit in a known manner not shown in FIG. 2.

In the hydraulic fluid circuit shown in FIG. 2, the hydraulic cylinders 6–8 are shortened when the pilot valves 19–21 are each brought to position A, and lengthened when they are each brought to position B.

When the pilot valve 19 is actuated to operate the boom cylinder 6, the boom cylinder 6 receives a supply of hydraulic fluid from the hydraulic pumps 9, 10 via the two control valves 13, 14, so that the boom cylinder 6 operates at high speed. However, when the pilot valve 20 is actuated to operate the arm cylinder 7, it is only from the hydraulic pump 9 that the hydraulic fluid is supplied to the arm cylinder 7 via the single directional control valve 15. Thus, the arm cylinder 7 operates at low speed, and the hydraulic pump 10 is not utilized to actuate the arm cylinder 7. Likewise, when the bucket cylinder 8 is operated, hydraulic fluid only from the hydraulic pump 10 is supplied to the bucket cylinder 7 via the single directional control valve 16, so that the bucket cylinder 8 operates at low speed and the hydraulic pump 9 is not utilized to actuate the bucket cylinder 8. Thus, on might consider that if the arm cylinder 7 and the bucket cylinder 8 are operated by additionally providing a bucket control valve and an arm control valve to the directional control valve groups 11, 12, respectively, pressure fluid could be supplied from the hydraulic pumps 9, 10 to the arm cylinder 7 and bucket cylinder 8. However, when this is the case, even if the reserve control valve 38 of the directional control valve group 12 is utilized as an additional arm control valve, it would be necessary to provide an additional bucket control valve to the directional control valve group 11. This would create the need to manufacture a new five valve type directional control valve group, resulting in an increase in production cost and ending the advantage of using the two directional control valve groups 11, 12 of the same construction. Moreover, an increase in the size of the control valve group 11 raises the problem of securing necessary space for this purpose.

SUMMARY OF THE INVENTION

Accordingly, an object of the present invention resides in providing a hydraulic fluid circuit of a hydraulic shovel capable of increasing the speed at which the two hydraulic cylinders in the front of the hydraulic shovel are operated, while making effective use of the hydraulic pumps, reducing production cost and avoiding the problem of increasing the installation space.

In accordance with advantageous features of the present invention, a hydraulic fluid circuit for a hydraulic shovel is provided which includes a first hydraulic pump and a second hydraulic pump respectively connected to a first directional control valve group and a second directional control valve group, a first hydraulic cylinder and a second hydraulic cylinder respectively connected to first and second directional control valves of the first directional control valve group, a first working port of a third directional control valve of the second directional control valve group is connected to one cylinder chamber of the first hydraulic cylinder and a second working port of the third directional control valve is connected to one cylinder chamber of the second hydraulic cylinder.

DETAILED DESCRIPTION

Figure 1:
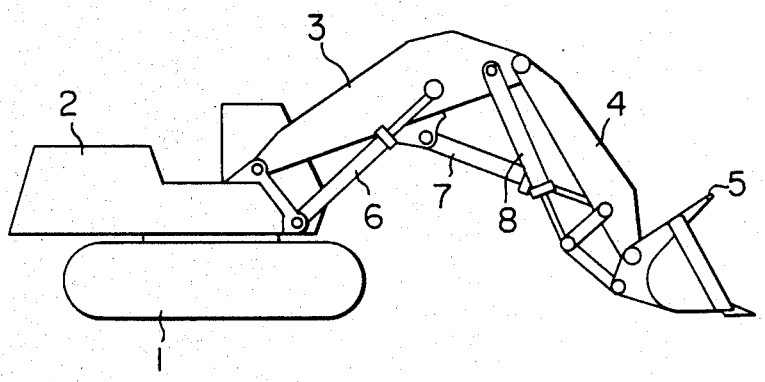
FIG. 1 is a side view of a loading shovel.
Figure 2:
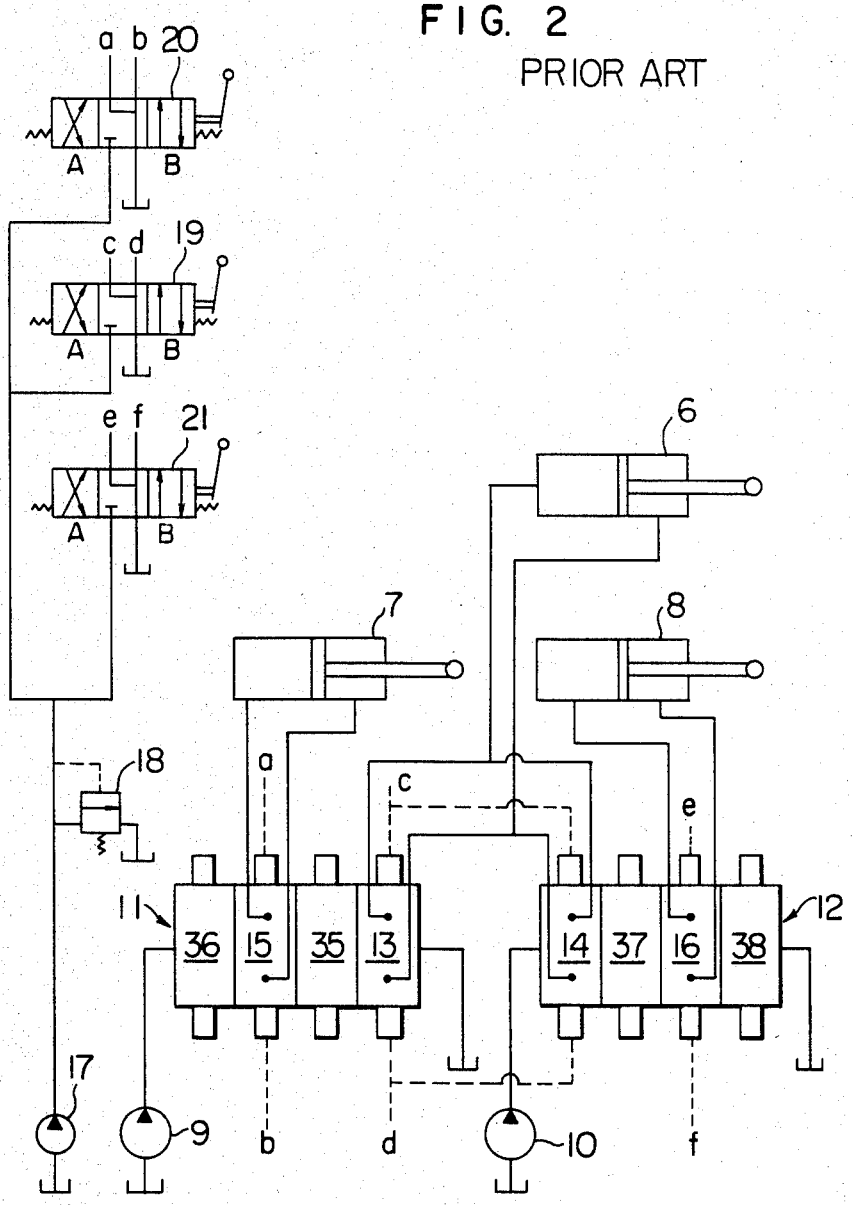
FIG. 2 PRIOR ART
FIG. 2 is a circuit diagram of a prior art hydraulic fluid circuit for a loading shovel.
Figure 3:
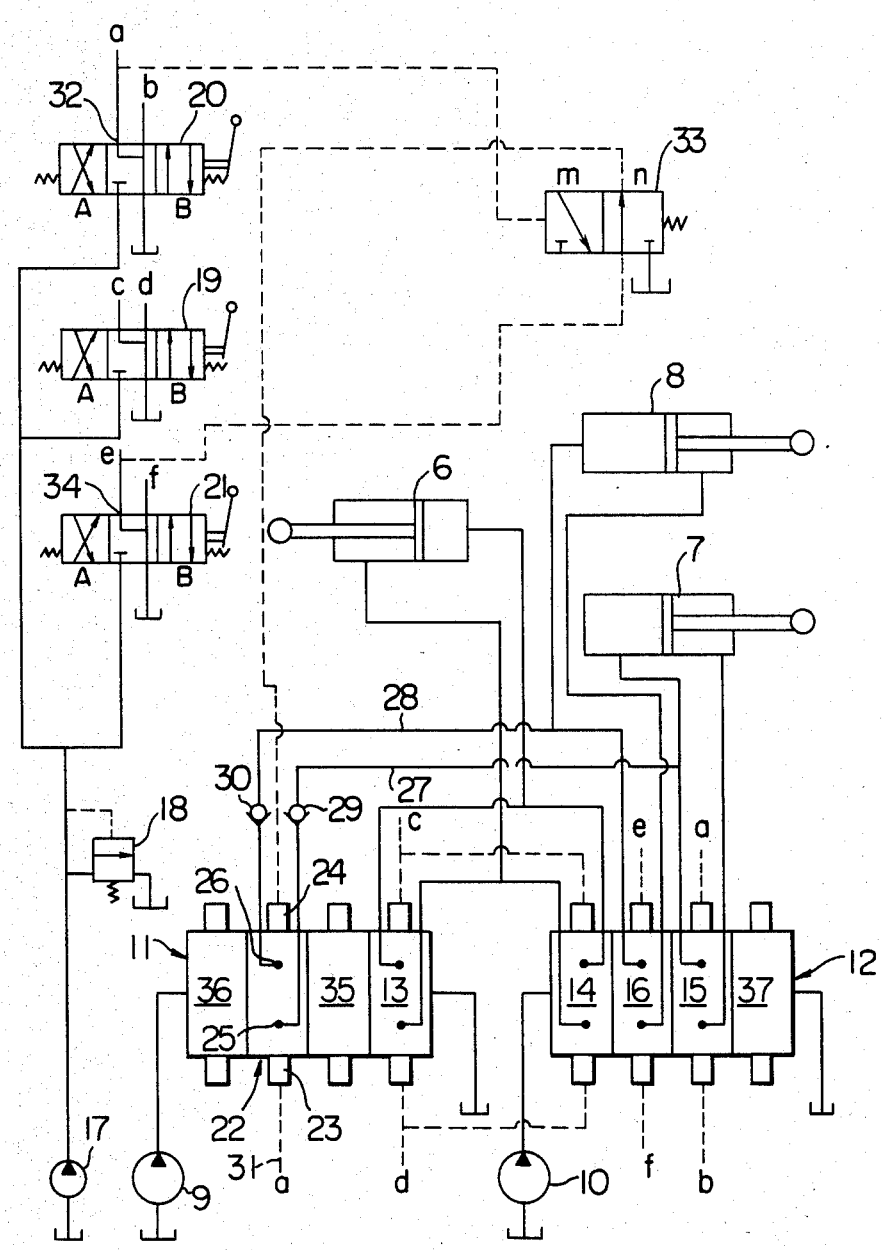
FIG. 3 is a circuit diagram of a hydraulic fluid circuit for a loading shovel constructed in accordance with the present invention.

As shown in FIG. 3, a hydraulic fluid circuit of a loading shovel of the present invention includes a directional control valve generally designated by the reference numeral 22 of a first directional control valve group 11, with the directional control valve 22 including pilot ports 23, 24 and working ports 25, 26 respectively connected by lines 27, 28 to bottom side chambers of the arm cylinder 7 and the bucket cylinder 8. Check valves 29, 30 are respectively mounted in the lines 27, 28, with a pilot line 31 connecting an output port 32 of the pilot valve 20 to the pilot port 23. A change-over valve 33 is normally disposed in a position n and changes to a position m when a pilot pressure is produced at the outlet port 32. When the change-over valve 33 is in the position n, an output port 34 of the pilot valve 21 communicates with the pilot port 24, and when the change-over valve 33 is in the position m, the pilot port 24 communicates with a tank. The arm control valve and bucket control valve 16 are arranged in the second directional control valve group 12.

In the above described hydraulic fluid circuit, when the pilot valve 20 is brought to position A, the arm control valve 15 alone is actuated and the hydraulic fluid is supplied from the hydraulic pump 10 to a rod side chamber of the arm cylinder 7, to shorten the arm cylinder 7. When the pilot valve 20 is brought to position B, both the arm control valve 15 and the directional control valve 22 are actuated, so that the hydraulic fluid is supplied from the hydraulic pumps 9, 10 to a bottom side chamber of the arm cylinder 7 to lengthen the arm cylinder 7 at high speed. When the pilot valve 21 is brought to position A, only the bucket control valve 16 is actuated and the hydraulic fluid is supplied from the hydraulic pump 10 to a rod side chamber of the bucket cylinder 8, to thereby shorten the bucket cylinder 8. When the pilot valve 21 is brought to position B, the bucket control valve 16 and directional control valve 22 are actuated since the change-over valve 33 is in position n, so that the hydraulic fluid is supplied from the hydraulic pumps 9, 10 to a bottom side chamber of the bucket cylinder 8 to lengthen the bucket cylinder 8 at high speed. When the pilot valves 20, 21 are simultaneously brought to position B, the hydraulic fluid is supplied from the hydraulic pumps 9 and 10 to the bottom side chamber of the arm cylinder 7 because the change-over valve 33 moves to position m, so that the arm cylinder 7 is lengthened at high speed. However, only the bottom side chamber of the bucket cylinder 8 receives hydraulic fluid from the hydraulic pump 10, so that the bucket cylinder 8 is lengthened at normal speed.

While the above described hydraulic fluid circuit of the invention has been described in connection with a front loading shovel, it is apparent that the hydraulic fluid circuit of the invention can be used with a hydraulic back loading shovel. Also, while the direction of control valve 22 is automatically switched when the pilot valves 20, 21 are actuated, it is possible to provide an additional pilot valve for actuating the direction control valve 22. Moreover, the directional control valves 13–15 and 22, while described above as being of a pilot type, the invention is not limited to this specific type of directional control valves, and the directional control valves may be of a mechanical or an electromechanical type. Additionally, the hydraulic fluid may be supplied from the hydraulic pumps 9, 10 to the hydraulic cylinder 7, 8 when they are shortened. However, the bottom side chambers of the hydraulic cylinders 7, 8 each have a pressure receiving area about twice as large as that of the rod side chambers thereof, and a higher speed is required for lengthening the hydraulic cylinders 7 and 8 than for shortening them. Thus, it is effective to supply the hydraulic fluid from the hydraulic pumps 9, 10 to the hydraulic cylinders 7 and 8 when they are lengthened, as is the case with the embodiment described hereinabove. Moreover, the speed at which lengthening of the arm cylinder 7 is obtained is increased when the pilot valves 20, 21 are simultaneously brought to position B. However, the speed at which the bucket cylinder 8 is lengthened may be increased in place of the speed at which the arm cylinder 7 is lengthened.

From the foregoing description, it will be appreciated that the invention enables the speed at which two hydraulic cylinders are lengthened to be increased by merely adding another directional control valve to the directional control valves used heretofore, so that the efficiently with which excavation is carried out can be improved and the hydraulic pumps can be more effectively used. Since only one directional control valve is added, no appreciable increase in cost is involved, and since no increase in the size of the directional control valve groups is involved, no problem is raised as to the space for installing the hydraulic circuit. Moreover, the hydraulic fluid circuit according to the invention is easy to maintain.

What is claimed is:

1. A hydraulic fluid circuit for a hydraulic shovel, the hydraulic fluid circuit comprising:

a first hydraulic pump, a second hydraulic pump, a first directional control valve group connected to said first hydraulic pump including a first directional control valve connected to a first hydraulic cylinder, and a second directional control valve connected to a second hydraulic cylinder, a second directional control valve group connected to said second hydraulic pump including a third directional control valve having a first working port connected to one cylinder chamber of said first hydraulic cylinder and a second working port connected to one cylinder chamber of said second hydraulic cylinder, and a first pilot line means for introducing a first pilot pressure to said first directional control valve so as to switch said first directional control valve to a position in which hydraulic fluid from said first hydraulic pump is supplied to said one cylinder chamber of said first hydraulic cylinder and for introducing the first pilot pressure to a first pilot port for switching said third directional control valve to a first position in which hydraulic fluid from said second hydraulic pump is supplied to said first working port, a second pilot line means for introducing a second pilot pressure to said second directional control valve so as to switch said second directional control valve to a position in which hydraulic fluid from said first hydraulic pump is supplied to said one cylinder chamber of said second hydraulic cylinder and for introducing the second pilot pressure to a second pilot port for switching said third directional control valve to a second position in which working fluid from said second hydraulic pump is supplied to said second working port, and a change-over valve means mounted in a line of said second pilot line means, said first pilot line means including a pilot line actuating said change-over valve means such that, when said first pilot pressure is not generated, said change-over valve means introduces said second pilot pressure to the second pilot port of said third directional control valve by communicating said line of said second pilot line means with said third directional control valve, and, when said first pilot pressure is generated, said pilot line means is operable to actuate said change-over valve means to a position blocking said line of said second pilot line means and communicating said second pilot port to a tank.

2. A hydraulic fluid circuit as claimed in claim 1, wherein said first hydraulic cylinder is an arm cylinder and said second hydraulic cylinder is a bucket cylinder.

3. A hydraulic fluid circuit as claimed in claim 1, wherein said first and second working ports are respectively connected to bottom side chambers of said first and second hydraulic cylinders.

* * * * *